US007013487B2

(12) United States Patent
Béland

(10) Patent No.: US 7,013,487 B2
(45) Date of Patent: Mar. 21, 2006

(54) METHOD OF MAKING A PROTECTIVE PAD

(75) Inventor: Jean-François Béland, Montreal (CA)

(73) Assignee: Bauer Nike Hockey Inc., St. Jérome (CA)

( * ) Notice: Subject to any disclaimer, the term of this patent is extended or adjusted under 35 U.S.C. 154(b) by 135 days.

(21) Appl. No.: 10/391,810

(22) Filed: Mar. 20, 2003

(65) Prior Publication Data

US 2004/0181850 A1 Sep. 23, 2004

(51) Int. Cl.
*A41D 13/00* (2006.01)

(52) U.S. Cl. ..... 2/22

(58) Field of Classification Search ..... 2/22, 2/16, 24, 455, 908, 911, 242, 62, 910; 602/16, 602/20, 23, 26; 128/878, 882
See application file for complete search history.

(56) References Cited

U.S. PATENT DOCUMENTS 2,266,886 A * 12/1941 McCoy ..... 2/22
2,785,407 A * 3/1957 Reeder ..... 2/22
4,756,026 A 7/1988 Pierce, Jr.
5,656,023 A 8/1997 Caprio, Jr. et al.
5,784,715 A * 7/1998 Buchanan ..... 2/22
5,840,397 A 11/1998 Landi et al.
6,065,152 A 5/2000 Parker
6,094,743 A 8/2000 Delgado
6,122,768 A 9/2000 McCrane
6,128,779 A * 10/2000 Goldsmith et al. ..... 2/22
6,145,134 A * 11/2000 Davis et al. ..... 2/463
6,156,000 A 12/2000 Chen et al.
6,178,556 B1 * 1/2001 Foreman et al. ..... 2/22
6,237,149 B1 5/2001 MacDonald
6,317,888 B1 11/2001 McFarlane
6,336,220 B1 1/2002 Sacks et al.
6,654,961 B1 * 12/2003 Beland ..... 2/22
6,789,264 B1 * 9/2004 Budda ..... 2/22

* cited by examiner

*Primary Examiner*—Tejash Patel

(57) ABSTRACT

A method of making a protective pad, which comprises fastening a plurality of sections together to create an outer shell, providing an inner shell made of a more rigid material than the sections making up the outer shell, fastening the inner shell to the outer shell (thereby to form a composite shell) and fastening the composite shell to a padding liner. The use of plural sections forming the outer shell reduces manufacturing costs. An overlay may be placed over the outer shell to conceal the areas where the sections making up the outer shell are fastened together. Fastening the composite shell to the padding liner may include passing through a thinned out portion of the hard inner shell, or it may bypass the inner shell altogether, thus avoiding the use of heavy duty stitching equipment. The step of fastening the inner and outer shells may include gluing rather than stitching.

29 Claims, 9 Drawing Sheets

METHOD OF MAKING A PROTECTIVE PAD

FIELD OF THE INVENTION

The invention relates to a method of making a protective garment for shielding a body part of a player from impacts by extraneous objects. The invention is particularly although not exclusively directed to the manufacture of protective pads in the form of elbow pads, knee pads, shin pads and the like, as used for playing hockey and other sporting activities.

BACKGROUND OF THE INVENTION

Protective pads are useful for protecting a wearer's body parts from injury. Most commonly, protective pads are made to include an outer shell that is hard and an inner shell that is soft. Such protective pads are typically strapped to a desired degree of tightness around the part requiring protection, e.g., a wearer's elbow, knee, shin, etc. Accordingly, the interior of the protective pad is usually cup-shaped so as to comfortably receive the body part requiring protection.

However, although such a protective pad of the type described above may effectively protect the wearer from injury due to extraneous objects, the pads themselves present a risk of injuring other players. This is particularly true in the case of elbow pads, which are commonly raised to face level during close interactions amongst hockey players.

There is therefore a need in the industry for an improved method of manufacturing protective pads having an outer surface that possess shock absorbing qualities.

SUMMARY OF THE INVENTION

According a broad aspect, the invention seeks to provide a method of making a pad for protection of a wearer's body part, comprising: (a) fastening a plurality of sections together to create an outer shell having an interior surface and an exterior surface, the outer shell being made of a first material; (b) providing an inner shell having an exterior surface conforming to the interior surface of the outer shell, the inner shell being made of a second material of greater rigidity than the first material; (c) fastening the exterior surface of the inner shell to the interior surface of the outer shell, thereby to form a composite shell; (d) providing a padding liner for contacting the wearer's body part when the pad is worn by the wearer; and (e) fastening the composite shell to the padding liner.

According to a second broad aspect, the present invention may be summarized as a method of making a pad for protection of a wearer's body part, comprising: (a) providing an outer shell having an interior surface and an exterior surface, said outer shell being made of a first material; (b) providing an inner shell having an exterior surface conforming to the interior surface of the outer shell, the inner shell being made of a second material of greater rigidity than the first material; (c) gluing the exterior surface of the inner shell to the interior surface of the outer shell, thereby to form a composite shell; (d) providing a padding liner for contacting the wearer's body part when the pad is worn by the wearer; and (e) fastening the composite shell to the padding liner.

These and other aspects and features of the present invention will now become apparent to those of ordinary skill in the art upon review of the following description of specific embodiments of the invention in conjunction with the accompanying drawings.

DETAILED DESCRIPTION OF THE EMBODIMENTS

Figure 1:
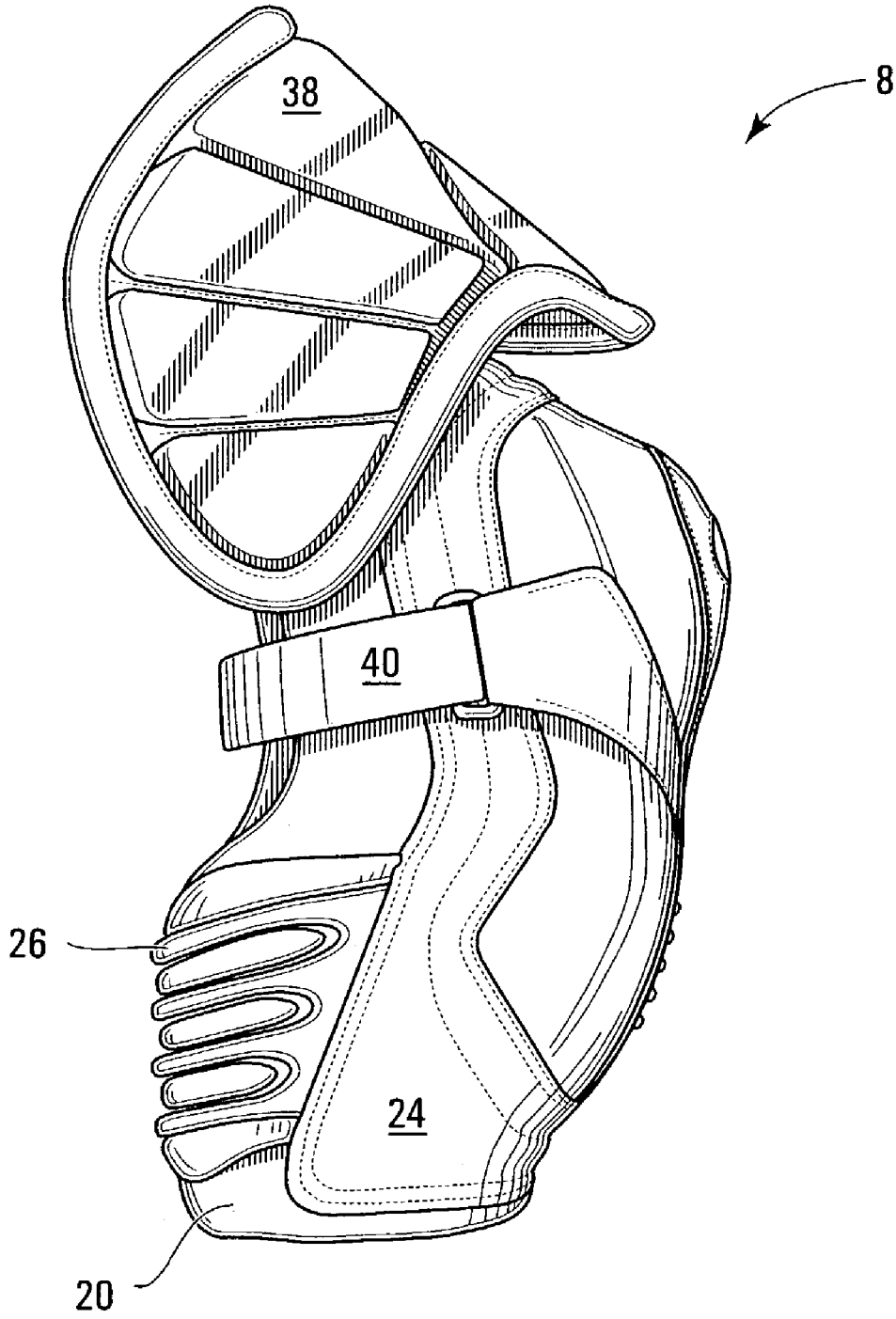
FIG. 1 depicts a right side elevational view of a protective pad made in accordance with an embodiment of the present invention.
Figure 1A:
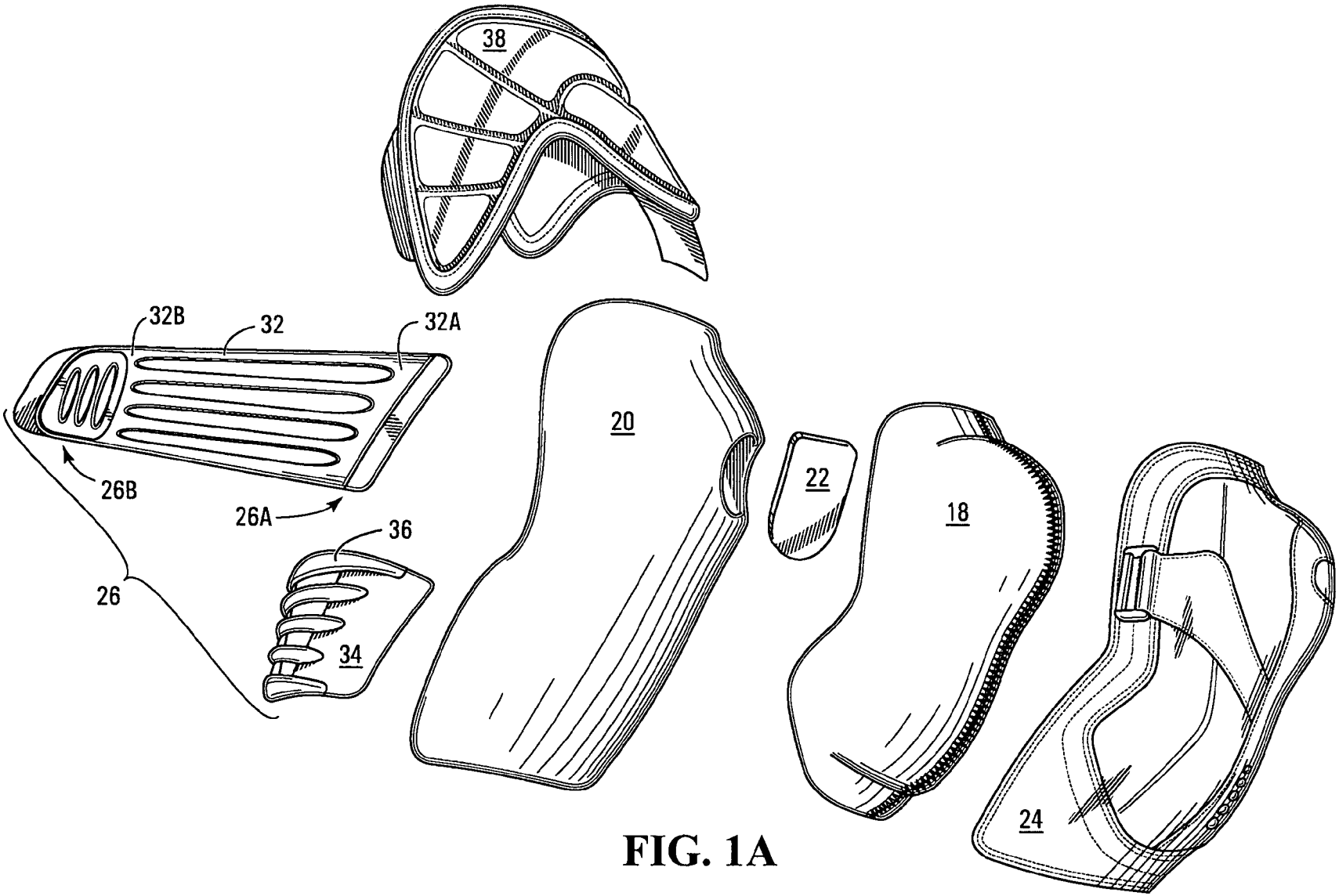
FIG. 1A shows various components of the pad of FIG. 1 in exploded perspective view.

With reference to FIGS. 1 and 1A, a protective elbow pad 8 comprises a composite shell 18, a padding liner 20, a shock absorbing cushion 22, an overlay 24, a forearm strap 26, a biceps protector 38 and a joint strap 40. It should be understood that the various components of the elbow pad 8 are shown for purposes of example only and that not all of the illustrated components are necessary features of a pad manufactured in accordance with an embodiment of the present invention.

Figure 2:
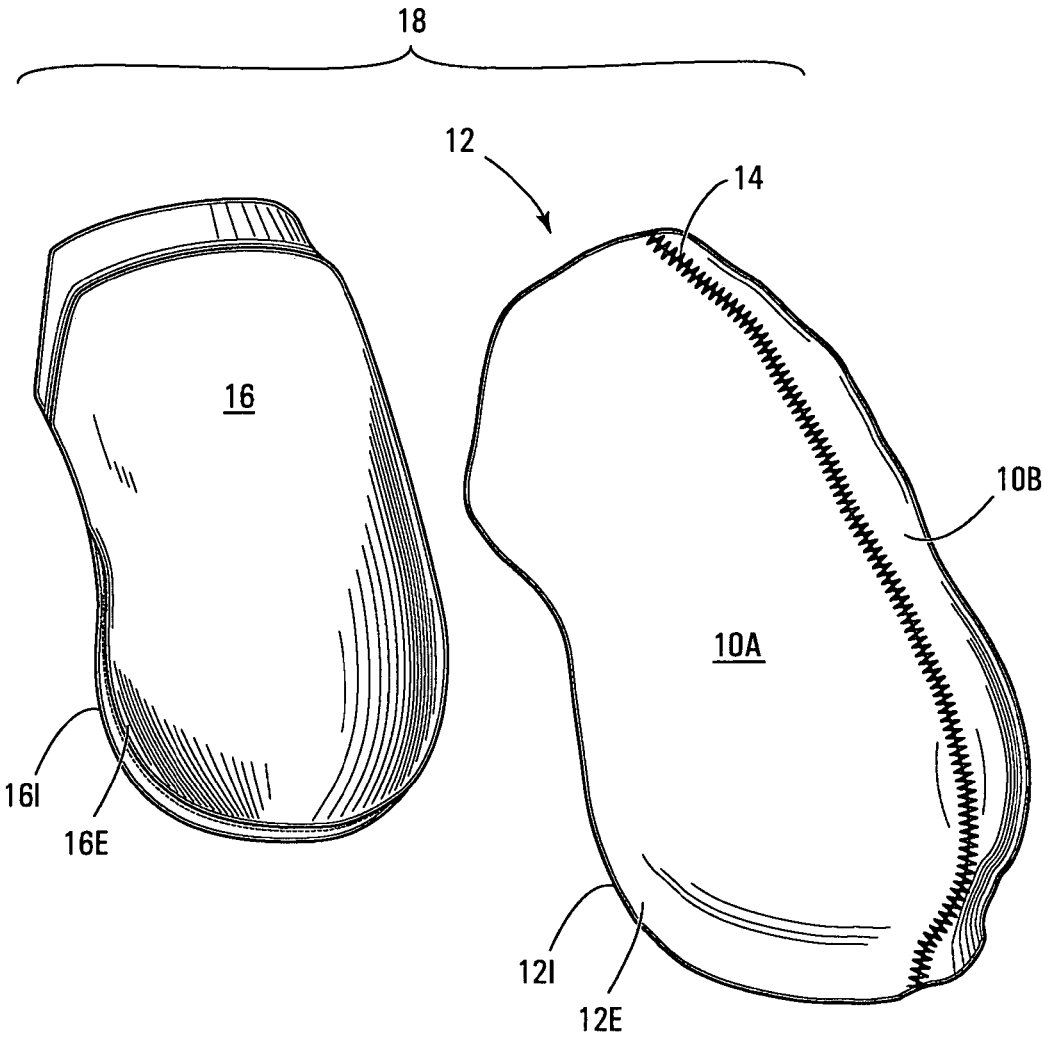
FIGS. 2 through 5 show perspective views of the protective pad of FIG. 1 at various stages of manufacture in accordance with an embodiment of the present invention.

With reference to FIG. 2, there is shown a plurality of sections 10A, 10B fastened together to create an outer shell 12 having an interior surface 12I and an exterior surface 12E. In the case of an elbow pad, the interior surface 12I of the outer shell 12 may be cup-shaped, although this is not a requirement of the present invention. Each of the sections 10A, 10B may be a foam section produced by a compression molding process known to those of ordinary skill in the art. Of course, other materials or combinations of materials may be used which provide shock absorbing properties. In the illustrated embodiment, the number of two foam sections is two and these are mirror images of one another, which may reduce the cost of manufacture. Thus, in the illustrated embodiment, the two foam sections 10A, 10B have the shape of "half-shells" and are fastened (e.g., stitched) along a curvilinear junction area 14. It will be understood that the number and configuration of the sections 10A, 10B can vary. Thus, for example, the outer shell 12 may consist of a single integral foam section, which eliminates the presence of a junction area 14.

Figure 3:
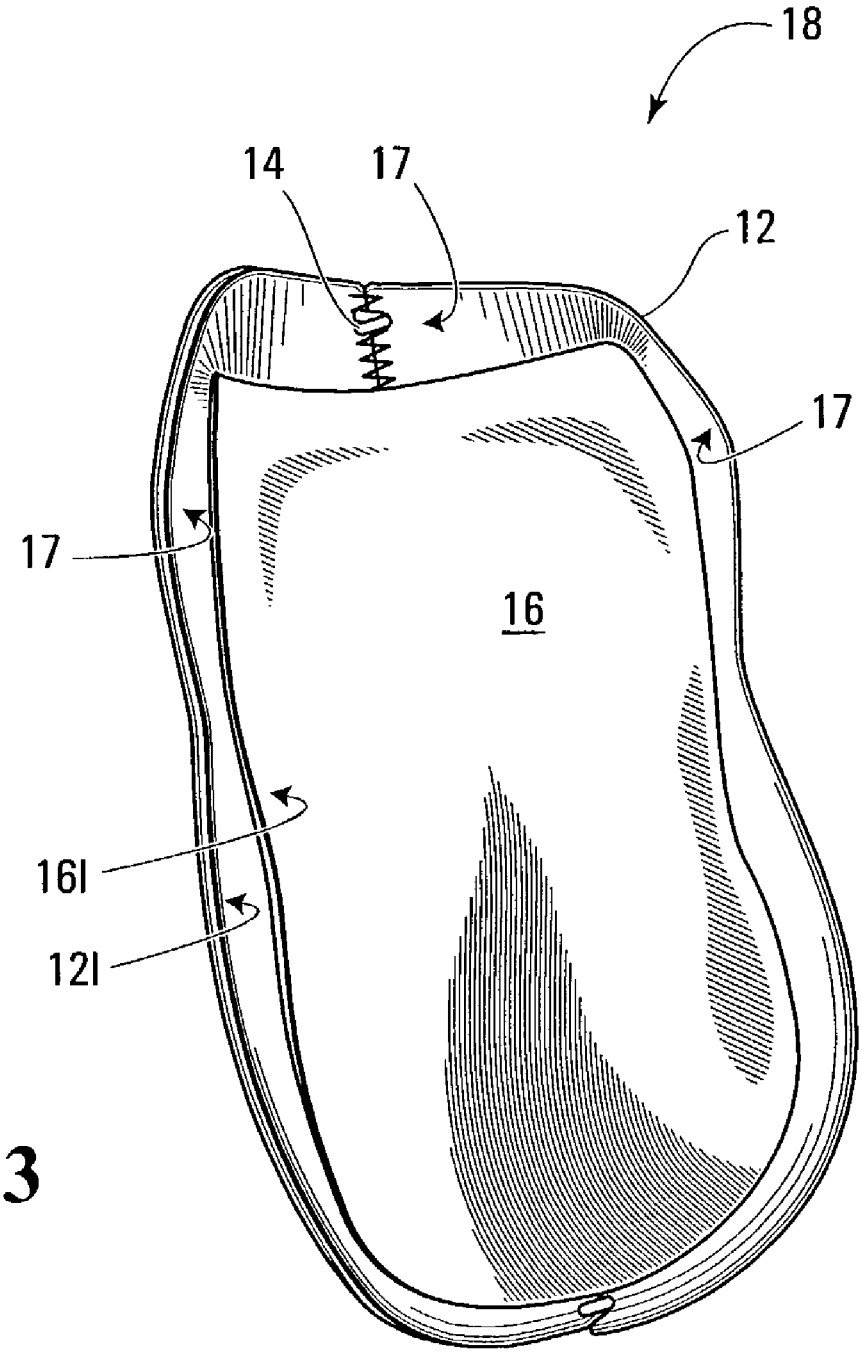

Also shown an inner shell 16, which is fastened, e.g., by gluing, to the interior surface 12I of the outer shell 12, thereby resulting the formation of the composite shell 18 (also seen in FIG. 3). The inner shell 16 is made of a material that is more rigid than that of the outer shell 12. Also, the inner shell 16 has an exterior surface 16E that generally conforms to the interior surface 12I of the outer shell 12. In the case of an elbow pad, it is advantageous for the interior surface 16I of the inner shell 16 to be cup-shaped. In the illustrated example embodiment, it is noted that the inner shell 16 is completely surrounded by the outer shell 12, that is, the edge of the outer shell 12 extends beyond the inner shell 16 and defines a strip 17 that surrounds the inner shell 16.

Moreover, the inner shell 16 may have a variable thickness. Specifically, the inner shell 16 may have a first region and a second region, the first region have an average thickness less than the average thickness of the second region. In one embodiment, the first region will form a periphery of the inner shell 16. Thus, the periphery of the inner shell 16 will be "thinned out" with respect to the interior region of the inner shell 16. This may be of advantage during a stitching process, as described in further detail later on.

Figure 4:
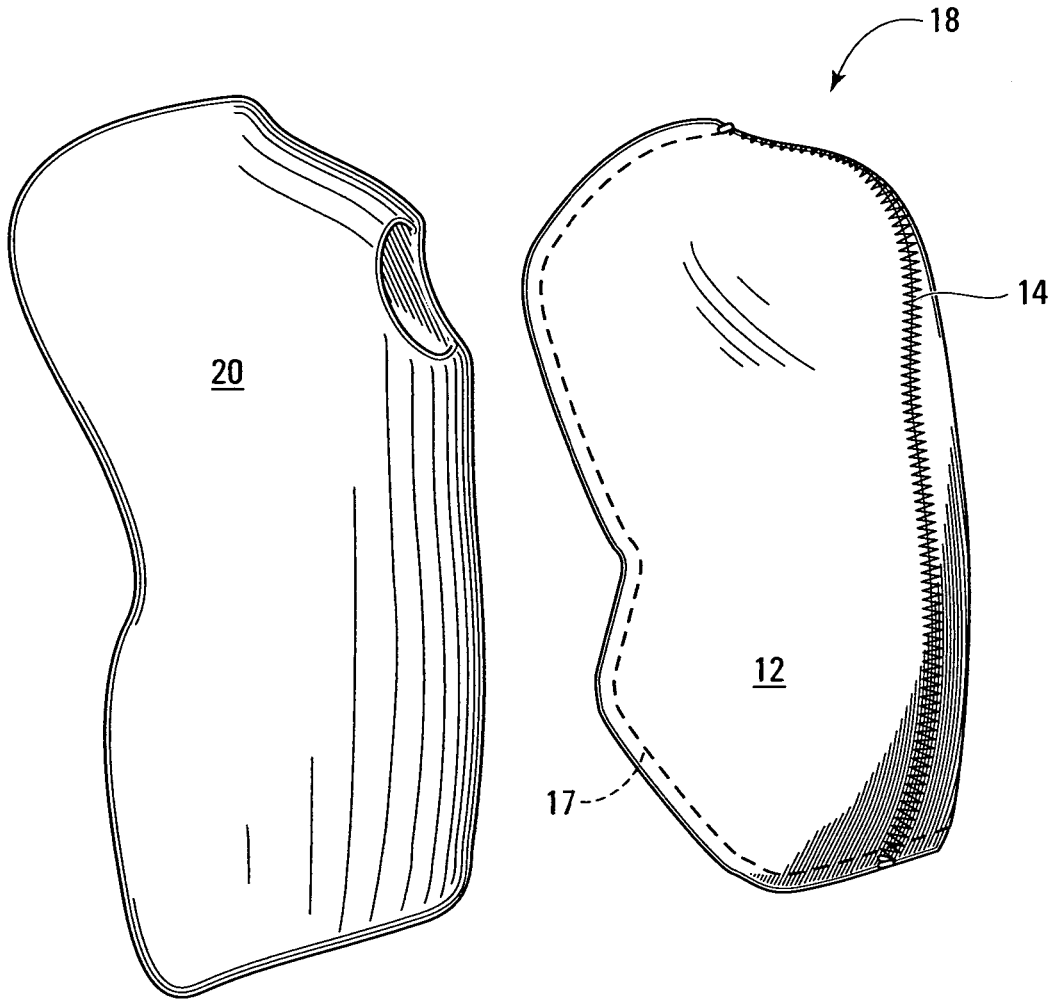
Figure 4A:
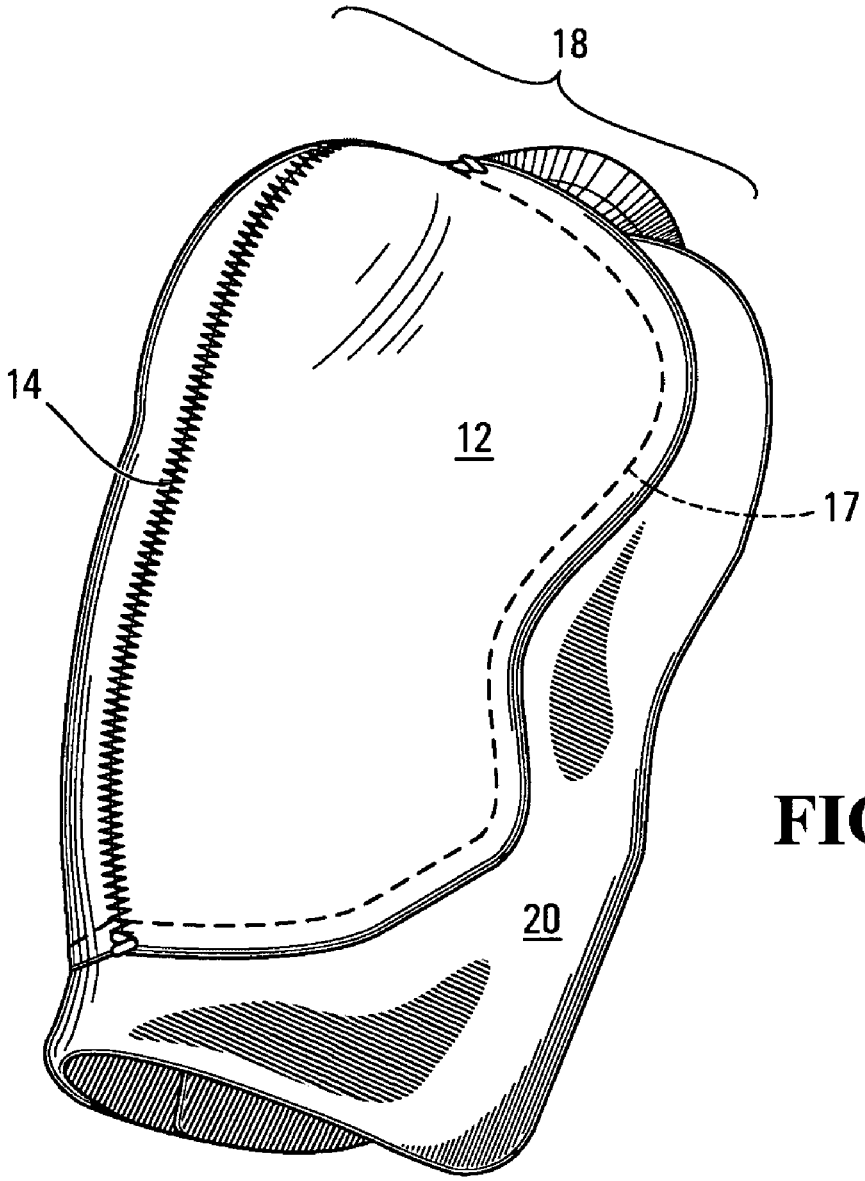

Reference is now made to FIGS. 4 and 4A. The manufacturing process continues by fastening the composite shell 18 to the padding liner 20. The padding liner 20 is a layer of material that is in contact with the protected body part (e.g., elbow) of the wearer when the pad is being worn. Advantageously, the padding liner 20 is softer than the inner shell 16. The padding liner 20 can be of any suitable material or composition to provide the degree of cushioning and protection that is desired. The padding liner 20 may be made of the same material or combination of materials as the outer shell 12 or it may be made of a different material or combination of materials. For example, the padding liner 20 can be formed from a relatively thick foam material covered by layers of woven synthetic yarn. In a specific instance, the padding liner 20 may comprise a closed cell foam of ethylene vinyl acetate of a suitable thickness covered by mesh outer layers of a woven synthetic material such as polyester.

The composite shell 18 may be fastened to the padding liner 20 by various methods such as stitching. In some embodiments, to ensure good resistance to impact and good energy absorption, the outer shell 12 may be stitched to the padding liner 20 by passing through the somewhat thinner periphery of the inner shell 16. In other embodiments, the strip 17 of the outer shell 12 may be fastened (e.g., stitched) directly to the padding liner 20, so that it is not necessary to pierce the hard inner shell 16. In both cases, the use of heavy-duty stitching needles can be avoided.

It is also noted that fastening of the outer shell 12 to the padding liner 20 (either through or bypassing the inner shell 16) may occur at the same time as fastening of the outer shell 12 to the inner shell 16. In other words, a strict serial order of steps is not to be understood from the above description. For example, it is envisaged that a quantity of glue may be spread onto the exterior surface 16E of the inner shell 16 (e.g., towards the thicker interior of the inner shell 16), following which the outer shell 12 is placed over the inner shell 16 and, shortly thereafter, either the strip 17 is fastened to the padding liner 20 or the outer shell 12 is fastened to the padding liner 20 via the inner shell 16. This would result in simultaneous fastening of the composite shell 18 to the padding liner 20 and of the outer shell 12 to the exterior surface 16E of the inner shell 16.

In some embodiments, it is envisaged to fasten the composite shell 18 to the padding liner 20 in such a way as to leave a space between the hard inner shell 16 composite shell and the padding liner 20 (e.g., near the apex of the cup-shaped interior surface 16I of the inner shell 16). It is within the scope of the present invention to dispose shock absorbing cushion 22 in the space between the inner shell 16 and the padding liner 20.

Figure 4B:
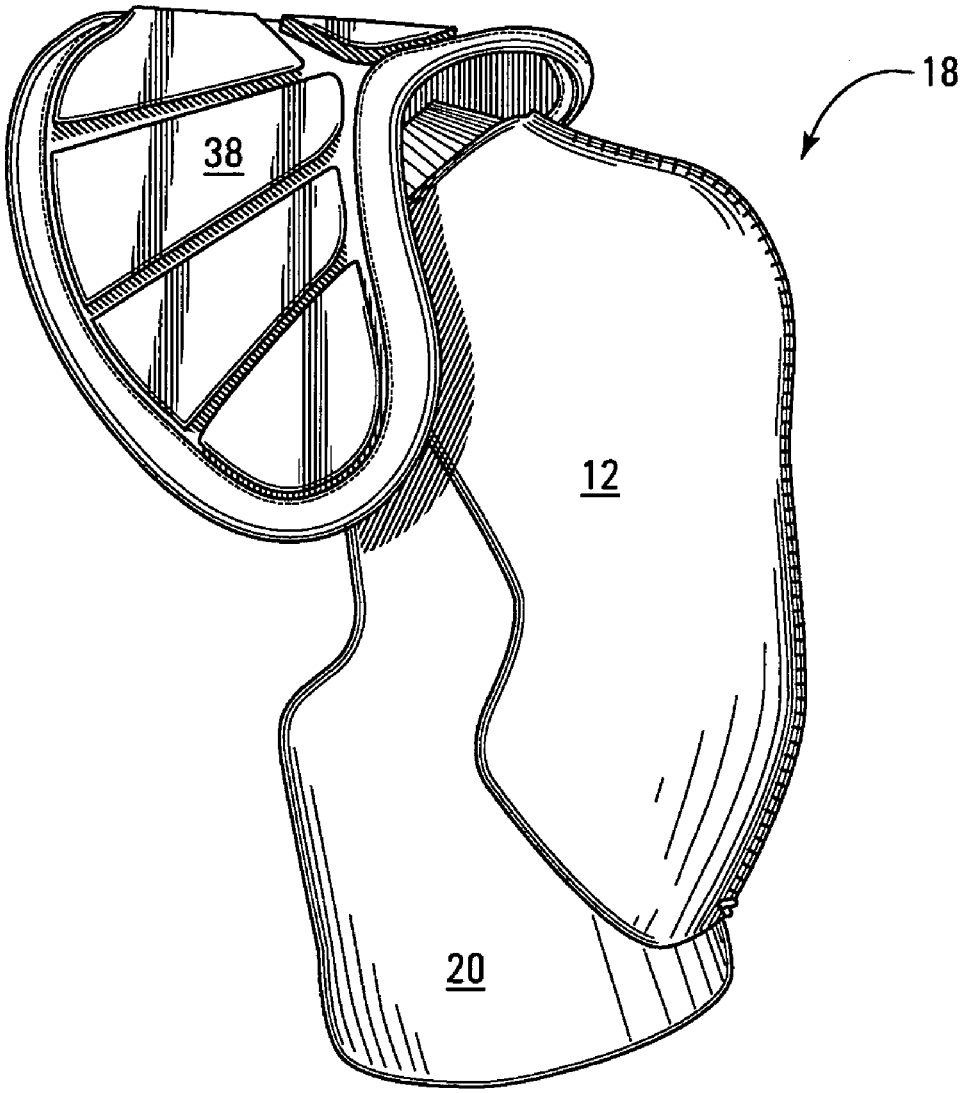

Moreover, as seen in FIG. 4B, a further step may consist of attaching the biceps protector 38 to the padding liner 20.

Figure 5:
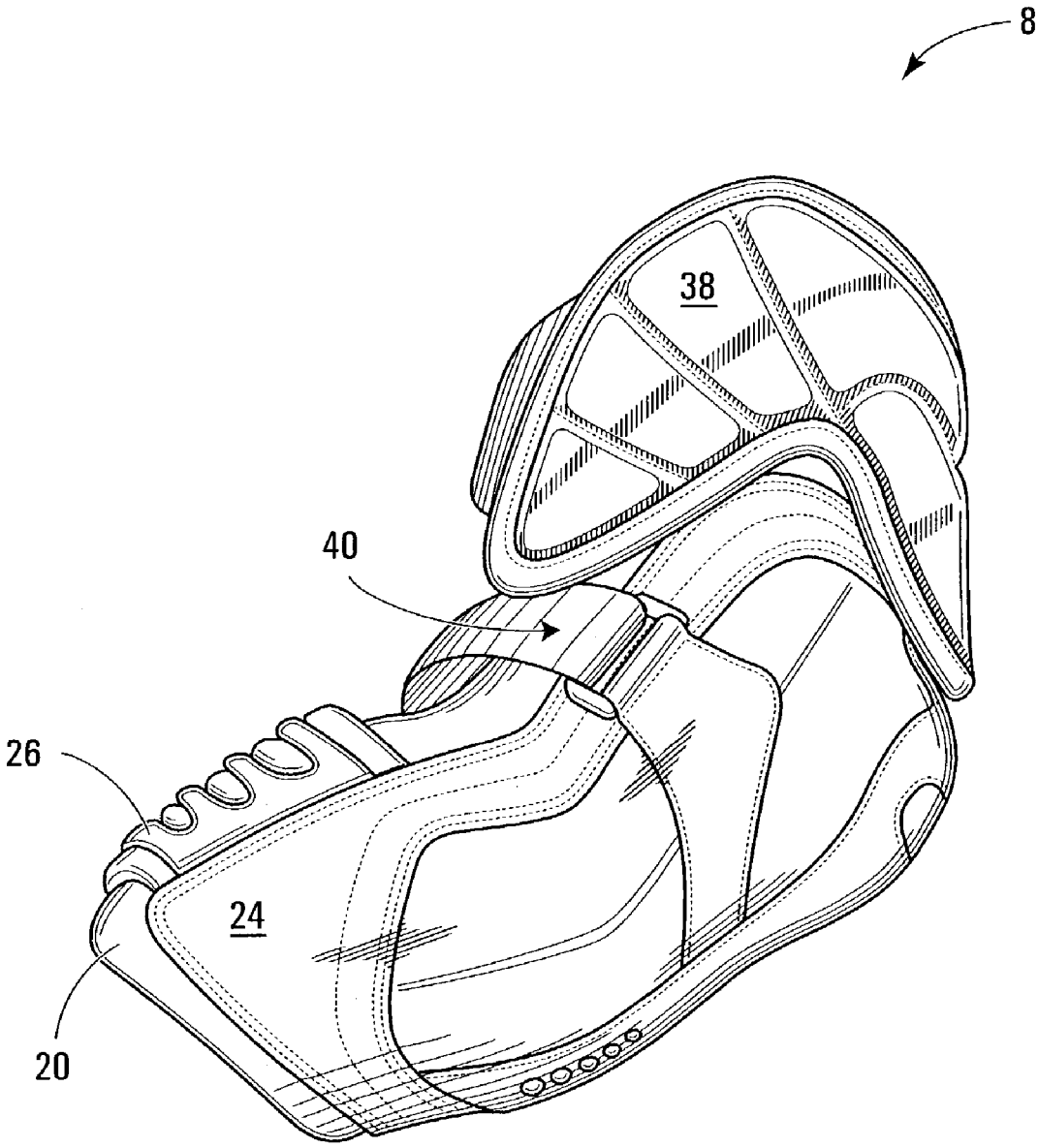

With reference now to FIG. 5, there is an overlay 24 that is placed over at least part of the composite shell 18 (no longer visible in FIG. 5). The overlay 24 is typically a synthetic or natural fabric that can be made to exude a particular design, numeral, color pattern, etc. In addition, the overlay 24 can be appropriately dimensioned so as to cover the junction area(s) 14 where the plurality of foam sections 10A, 10B are joined. In this way, the junction area(s) 14 will be concealed by the overlay 24, thereby providing for a more aesthetically pleasing appearance, while allowing a particular design to be visible. Moreover, the overlay 24 may also be suitably dimensioned to conceal the strip 17 where the composite shell 18 meets the padding liner 20 and hence conceal the entire composite shell 18. Thus, the strip 17 is not visible in FIG. 5. The overlay 24 may be fastened to the padding liner 20 by any conventional method such as stitching. Due to the oversized dimensions of the overlay 24, there is again no need to pierce the inner shell 16. It is noted that the overlay 24 may also include a joint strap 40, which can be made thinner than the biceps protector 38, permitting the wearer to secure the pad in the area of the elbow, for example.

Thus, it can be seen that a protective pad made in accordance with embodiments of the present invention have at least two protective features in use. Firstly, the wearer's body part (e.g., elbow) is protected against impact from extraneous objects by the combination of the inner shell 16 and the padding liner 20 and, optionally, the shock absorbing cushion 22. Secondly, the extraneous objects themselves are protected by the outer shell 12, which is made of foam and is softer than the inner shell 16. The latter feature is especially advantageous when the extraneous objects (e.g., an opponent's face) are more sensitive to impact than the wearer's body part (e.g., elbow).

Figure 6A:
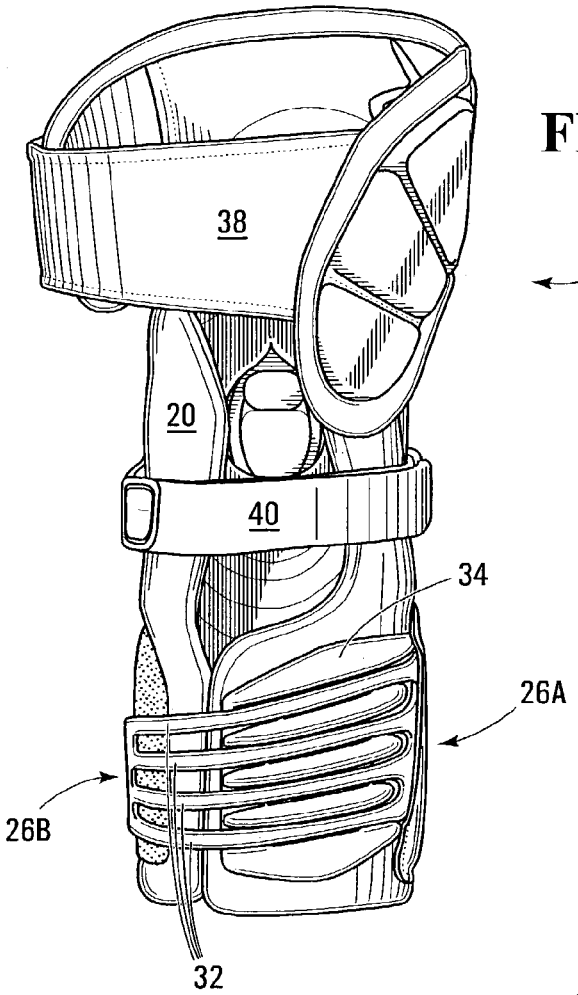
FIG. 6A shows the view of FIG. 1, turned at about 45 degrees towards the rear.
Figure 6B:
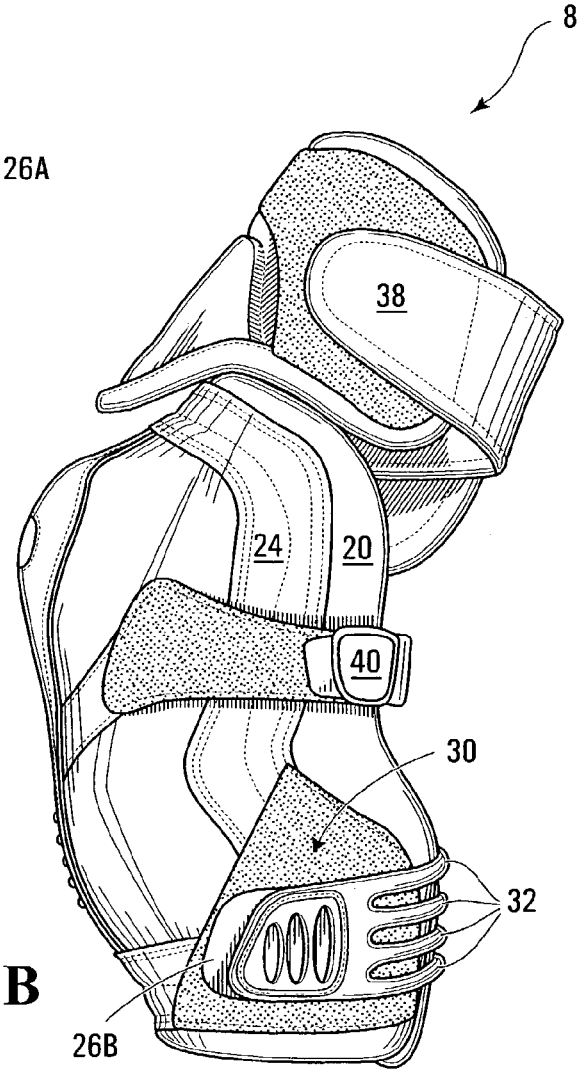
FIG. 6B shows a left side elevational view of the protective pad of FIG. 1.

The process of making the elbow pad 8 may include yet further additional steps during which various optional features are added. For example, it is within the scope of the present invention to mount a forearm strap 26 to the elbow pad 8 that permits the pad 8 to be tightened around the wearer's forearm arm. In one embodiment, shown in FIGS. 6A and 6B and with additional reference to FIG. 1A, the forearm strap 26 has two ends 26A, 26B, where the first end 26A may be permanently affixed to the pad 8, while the second end 26B may be free for eventual attachment to the pad 8. Specifically, the first end 26A can be attached to the padding liner 20 or, if more convenient, it may be attached to the overlay 24.

In order to permit the forearm strap 26 to be suitably tightened, a fastener is provided whereby the second end 26B of the forearm strap 26 may be affixed to the pad 8. The fastener may include a first component (not visible) mounted to the second (free) end 26B of the forearm strap 26 and a second component 30 mounted to the padding liner 20 (and/or to the overlay 24). The first component and the second component 30 of the fastener cooperate to allow the forearm strap 26 to be tightened to a desired level of tension, and to be released at a desired moment. In the illustrated embodiment, the fastener is a hook-and-loop fastener (e.g., VELCRO™), where first component is a set of hooks and the second component 30 is a set of loops. The reverse arrangement is also possible. In still other embodiments, the fastener may simply consist of cooperating components of a button, a lace, a buckle or a belt.

Various configurations of the forearm strap 26 itself are envisaged. In the embodiment shown in FIGS. 6A, 6B and 1A, the forearm strap 26 is depicted as comprising a plurality of stretchable bands 32 and a rigid portion 34 for supporting the bands 32. The stretchable bands 32 extend generally side by side, while the rigid portion 34 comprises rounded projections 36 disposed between the bands 32 for maintaining separation therebetween. The rigid portion 34 has a curvature that generally follows the curvature of an average wearer's arm. The rigid portion 34 meets the overlay 24 (and/or the padding liner 20) at the first end 26A of the forearm strap 26. The bands 32 include a first end 32A, which meets the overlay 24 (and/or the padding liner 20) at the first end 26A of the forearm strap 26. The bands 32 also include a second end 32B, which corresponds to the second (free) end 26B of the forearm strap 26.

Although the forearm strap 26, the biceps protector 38 and the joint strap 40 are all shown as having the same configuration for fastening (see FIG. 6B), it should be understood that any number of the strap 26, 38, 40 can have the same common configuration or different configurations.

It should also be understood that the present invention is not to be limited to the embodiments described herein above in the context of manufacturing an elbow pad 8. Rather, those of ordinary skill in the art will appreciate that the present invention can be applied to the manufacture of other types of pads, e.g., shoulder pad, knee pad and generally any type of pad where both potential injury to the wearer from contact with an extraneous object, and potential injury to the extraneous object itself, are a concern.

While specific embodiments of the present invention have been described and illustrated, it will be apparent to those skilled in the art that numerous modifications and variations can be made without departing from the scope of the invention as defined in the appended claims.

What is claimed is:

1. A method of making a pad for protection of a wearer's body part, comprising:

(a) forming a plurality of foam sections by compression molding;

(b) fastening the plurality of foam sections together to create an outer shell having an interior surface and an exterior surface;

(c) providing an inner shell having an exterior surface conforming to the interior surface of the outer shell, the inner shell being more rigid than the outer shell;

(d) fastening the exterior surface of the inner shell to the interior surface of the outer shell for forming a composite shell wherein the outer surface of the inner shell is covered by the inner surface of the outer shell;

(e) providing a padding liner for contacting the wearer's body part when the pad is worn by the wearer; and (f) fastening the composite shell to the padding liner.

2. The method of claim 1, wherein the outer and inner shells are cup-shaped.

3. The method defined in claim 2, further comprising placing an overlay over at least part of the composite shell.

4. The method defined in claim 3, wherein the plurality of foam sections are fastened together at a set of junction areas and wherein placing the overlay over at least part of the composite shell includes concealing the junction areas.

5. The method defined in claim 4, wherein the composite shell meets the padding liner at a junction region and wherein placing the overlay over the at least part of the composite shell includes concealing the junction region.

6. The method defined in claim 5, wherein placing the overlay over at least part of the composite shell comprises fastening the overlay to the padding liner.

7. The method defined in claim 6, wherein fastening the overlay to the padding liner includes stitching the overlay to the padding liner.

8. The method defined in claim 6, wherein fastening the overlay to the padding liner creates a space between the composite shell and the padding liner.

9. The method defined in claim 8, further comprising providing a cushion in the space between the composite shell and the padding liner.

10. The method defined in claim 2, wherein fastening the inner shell to the interior surface of the outer shell includes gluing the inner shell to the interior surface of the outer shell.

11. A method of making a pad for protection of a wearer's body part, comprising:

(a) forming an outer shell of foam by compression molding, the outer shell having an interior surface and an exterior surface;

(b) providing an inner shell having an exterior surface conforming to the interior surface of the outer shell, the inner shell being more rigid than the outer shell;

(c) gluing the exterior surface of the inner shell to the interior surface of the outer shell for forming a composite shell wherein the outer surface of the inner shell is covered by the inner surface of the outer shell;

(d) providing a padding liner for contacting the wearer's body part when the pad is worn by the wearer; and (e) fastening the composite shell to the padding liner.

12. The method of claim 11, wherein the outer and inner shells are cup-shaped.

13. The method defined in claim 12, wherein the outer shell presents a region that extends beyond the inner shell and wherein fastening the composite shell to the padding liner includes fastening the outer shell to the padding liner in the region that extends beyond the inner shell.

14. The method defined in claim 13, wherein the region extending beyond the inner shell completely surrounds the inner shell.

15. The method defined in claim 14, wherein fastening the outer shell to the padding liner in the region that extends beyond the inner shell comprises fastening the outer shell to the padding liner only in the region that extends beyond the inner shell.

16. The method defined in claim 15, wherein fastening the outer shell to the padding liner includes stitching the outer shell to the padding liner.

17. The method defined in claim 12, wherein the inner shell presents a first region and a second region, the first region being thinner than the second region, and wherein fastening the composite shell to the padding liner includes fastening the outer shell to the padding liner through the first region of the inner shell.

18. The method defined in claim 17, wherein fastening the outer shell to the padding liner through the first region of the inner shell includes stitching the outer shell to the padding liner through the first region of the inner shell.

19. The method defined in claim 18, wherein the first region is peripheral to the inner shell 16 and wherein the second region is interior to the inner shell 16.

20. The method defined in claim 10, further comprising mounting a strap to at least one of the overlay and the padding liner.

21. An elbow pad made by the method defined in claim 20.

22. The elbow pad defined in claim 21, wherein the strap comprises a plurality of stretchable bands extending generally side by side and a rigid portion for supporting the bands.

23. The elbow pad defined in claim 22, wherein the rigid portion comprises rounded projections disposed between the bands for maintaining separation between the bands.

24. The elbow pad defined in claim 23, wherein the rigid portion is mounted to the padding liner or to the overlay.

25. The elbow pad defined in claim 24, wherein the bands include a first end fixed to the padding liner or the overlay, and a second end that is free with respect to the padding liner and the overlay.

26. The elbow pad defined in claim 25, further comprising a fastener comprising a first component mounted to the second end of the bands and a second component mounted to at least one of the padding liner and the overlay.

27. The elbow pad defined in claim 26, wherein the fastener is selected from the group consisting of hook and loop fastener, button, lace, buckle and belt.

28. An elbow pad made by the method defined in claim 2.

29. An elbow pad made by the method defined in claim 12.

* * * * *